US005496041A

United States Patent [19]

Broussard

[11] Patent Number: 5,496,041

[45] Date of Patent: Mar. 5, 1996

[54] ARROW PENETRATION BRAKE AND STOP ASSEMBLY

[76] Inventor: Hartwell N. Broussard, 900 Prairie Ave., Abbeville, La. 70510

[21] Appl. No.: 352,355

[22] Filed: Dec. 9, 1994

[51] Int. Cl.[6] ..... F42B 6/04

[52] U.S. Cl. ..... 273/416

[58] Field of Search ..... 273/416, 419–423

[56] References Cited

U.S. PATENT DOCUMENTS

| | | | |
|---|---|---|---|
| 2,684,851 | 7/1954 | Stokes | 273/106.5 |
| 2,796,262 | 6/1957 | Folberth, Jr. et al. | 273/423 |
| 2,970,839 | 2/1961 | Halverson | 273/416 |
| 2,989,310 | 6/1961 | Lamond | 273/416 |
| 3,667,758 | 6/1972 | Bengtsson | 273/423 |
| 3,756,602 | 9/1973 | Carella | 273/423 |
| 3,945,642 | 3/1976 | Henthorn, Jr. | 273/421 X |
| 4,003,576 | 1/1977 | Carella | 273/423 |
| 4,043,020 | 8/1977 | Hoggard | 29/427 |
| 4,111,424 | 9/1978 | Schreiber | 273/106.5 |
| 4,182,513 | 1/1980 | Henderson | 273/423 |
| 4,858,935 | 8/1989 | Capson | 273/416 |
| 4,905,397 | 3/1990 | Juelg, Jr. | 273/416 X |
| 5,022,658 | 6/1991 | Burkhart | 273/416 |
| 5,024,447 | 6/1991 | Jude | 273/416 |
| 5,167,417 | 12/1992 | Stacey et al. | 273/416 |
| 5,314,196 | 5/1994 | Ruelle | 273/416 |

OTHER PUBLICATIONS

Archer's Bible 1966–67; Mar. 1967; p. 83.

Bow & Arrow Hunting; Oct. 1985; Zwickey Archery, Inc. Advertisement; Zwickey Scorpio.

1986 Saunders Successories Catalog; Jul. 1986; p. 9; Arrow Penetration Limiter.

*Primary Examiner*—Paul E. Shapiro

*Attorney, Agent, or Firm*—David L. Ray

[57] ABSTRACT

An arrow penetration brake and stopping assembly for limiting the distance an arrow penetrates an object. The assembly includes a slidable penetration limiter assembly mounted on the shaft of an arrow and extending laterally therefrom, and a rigid stop mounted on the shaft of the arrow and extending partially around the circumference of the arrow shaft for limiting the distance that the penetration limiter can slide along the shaft of the arrow. A second embodiment of the invention has a shock absorber for decelerating an arrow after the arrow enters the object rigidly connected to the arrow between the stop and the penetration limiter.

17 Claims, 4 Drawing Sheets

ARROW PENETRATION BRAKE AND STOP ASSEMBLY

BACKGROUND OF THE INVENTION

1. Field of the Invention

The invention relates to archery, and, in particular, to arrows used in hunting game animals such as deer, elk, bear, and the like. More particularly, the present invention relates to arrow penetration limiter and braking systems.

2. Brief Description of the Related Art

A common problem encountered by hunters who use a bow and arrow is the location of game which has been hit with an arrow. Game such as deer, elk, and bear can run and walk long distances even though the hunter has placed an arrow accurately in the animal. To enable the hunter to locate game which has been hit with an arrow, arrows containing radio transmitters for location of the game are known in the art. The radio transmitter is mounted inside the shaft of the arrow near the point of the arrow and transmits a radio signal which can be detected by a radio receiver to locate a wounded or dead animal shot with the arrow containing the transmitter.

Such radio transmitters and receivers suffer from the disadvantage that the arrow may travel completely through the animal or the transmitter may protrude from the side of the animal and be broken off. If the arrow travels completely through the animal, the animal cannot of course be tracked. If the part of the arrow containing the radio transmitter penetrates completely through the animal and the arrow remains lodged initially in the animal, the transmitter-containing portion of the arrow may be broken off as the animal is running, and the animal cannot be tracked with the receiver. Furthermore, the expensive transmitter utilized in the arrow may stop transmitting radio signals and be lost.

Arrow penetration limiting and braking devices are known in the art utilizing gripper spring assemblies and O-rings. However, such devices do not always prevent the arrow from exiting or protruding from the animal, particularly when a powerful bow is being used by the hunter, and/or moisture from rain, fog, or snow decreases the resistance of the O-ring or gripper spring assembly. The arrow penetration limiting and braking devices of the prior art are utilized for anchoring the arrow to the game and also for finding the arrow in brush or the like if the arrow misses the animal.

A patent search on the invention revealed the following U.S. Pat. Nos.: 5,024,447; 5,022,658; 4,858,935; 4,111,424; 4,043,020; and 2,684,851.

SUMMARY OF THE INVENTION

In accordance with the present invention there is provided an arrow penetration brake and stopping assembly for limiting the distance an arrow penetrates an object. The assembly includes a slidable penetration limiter assembly mounted on the shaft of an arrow and extending laterally therefrom, and a rigid stop mounted on the shaft of the arrow and extending partially around the circumference of the arrow shaft for limiting the distance that the penetration limiter can slide along the shaft of the arrow. Preferably at least one elastic O-ring is mounted on the shaft of the arrow between the slidable penetration limiter assembly and the rigid stop.

The present invention has the advantage of limiting the distance an arrow penetrates an object with precision.

Furthermore, the present invention, when utilized on an arrow containing a radio transmitter, greatly increases the probability that the transmitter will be properly placed in an animal to enable tracking of the animal with a radio receiver.

A second embodiment of the invention has the further advantage of providing a shock absorber rigidly connected to an arrow for decelerating an arrow after the arrow enters an object.

DESCRIPTION OF THE PREFERRED EMBODIMENTS

Figure 1:
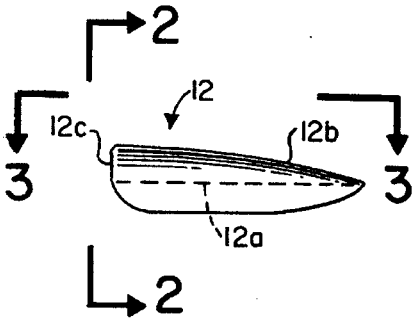
FIG. 1 is a side view of a first embodiment of a stop of the invention.

Referring now to the drawings, in FIGS. 4-7 is shown an arrow generally indicated by the numeral 10 having a first embodiment of the arrow stopping assembly of the invention connected thereto. Arrow 10 has a point 10*a* commonly called a broadhead having threads 11 shown in FIG. 7 which are connected to the front end of arrow shaft 10*b*. Nock 10*c* is connected to the rear end of arrow shaft 10*b*, and fletchings 10*d* are connected to shaft 10*b* adjacent to nock 10*c*.

Figure 2:
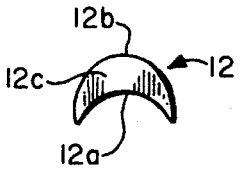
FIG. 2 is an end view of the stop of the invention taken along lines 2—2 of FIG. 1.
Figure 3:
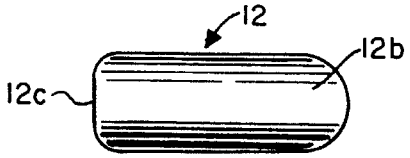
FIG. 3 is a top view, taken along lines 3—3 of FIG. 1.
Figure 4:
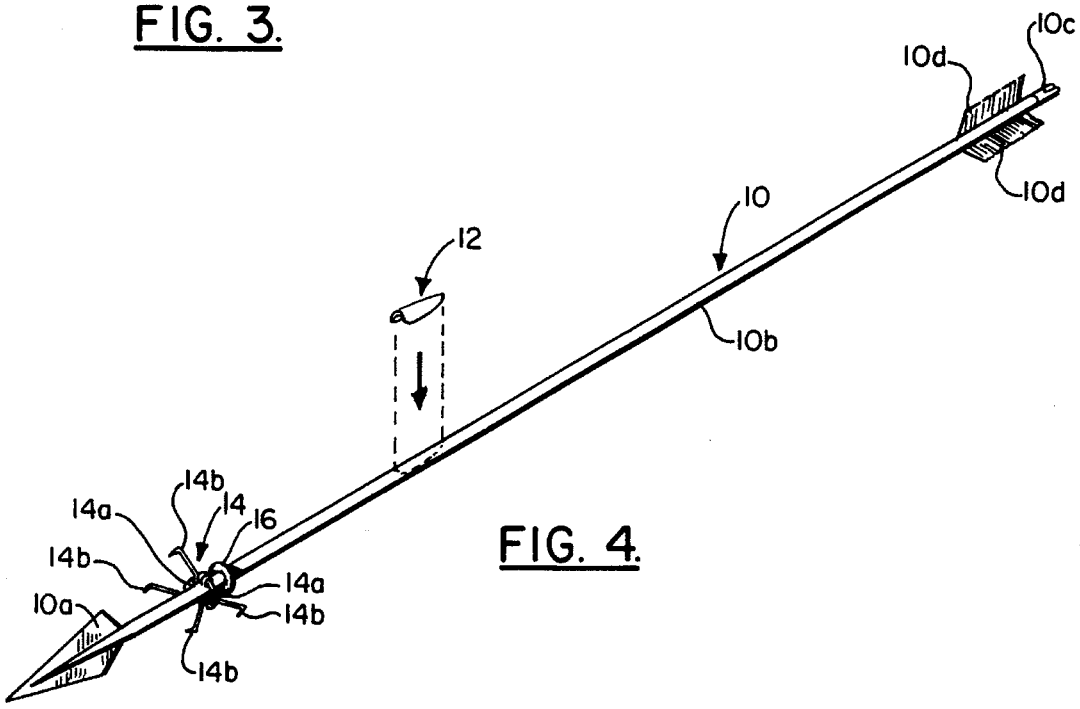
FIG. 4 is a perspective, partially exploded view of an arrow and a stop of the invention.

The arrow stopping assembly includes a stop generally indicated by the numeral 12 shown in detail in FIGS. 1–3, and a penetration limiter generally indicated by the numeral 14 shown in FIGS. 4–7. Preferably, an O-ring 16 is located between stop 12 and penetration limiter 14.

Penetration limiter 14 is located on shaft 10*b* adjacent to broadhead 10*a*. Penetration limiter 14 is known in the art and is commonly supplied with animal tracking systems such as that shown in U.S. Pat. No. 5,024,447, which is hereby incorporated by reference, having a radio receiver and arrows containing radio transmitters. A radio transmitter in arrow 10 is schematically indicated by phantom lines labeled 15 in FIG. 7 and an antenna connected to radio transmitter 15 is indicated by the numeral 15*a;* however the present invention may be used with conventional arrows that do not have radio transmitters. A penetration limiter of the prior art is disclosed in U.S. Pat. No. 5,022,658 which is also hereby incorporated by reference.

Penetration limiter 14 is identical to grabber spring assembly 38 in U.S. Pat. No. 5,022,658, except that penetration limiter 14 is connected directly to shaft 10*b* rather than to a main support bushing as shown in U.S. Pat. No. 5,022,658 and referred to as main support bushing member 36 in U.S. Pat. No. 5,022,658. Thus, penetration limiter 14 includes a plurality, preferably four, cooperating main spring members 14*a* connected together around shaft 10*b* and four arms 14*b* extending outwardly therefrom. Penetration limiter 14 preferably grips shaft 10*b* under tension from spring members 14*a* and is slidable thereon.

Stop 12 is rigidly connected to the shaft 10*b* of arrow 10 as shown in the drawings. Preferably stop 12 is about one inch to three inches in length. Stop 12 has an arcuate bottom surface 12*a* that contacts the surface of shaft 10*b* and mates therewith. The top surface 12*b* of stop 12 extends upwardly above bottom surface 12*a* to form front wall 12*c*. Top surface 12*b* slopes from front wall 12*c* downward to shaft 10*b*. Stop 12 extends above shaft 10*b* a distance sufficient for wall 12*c* to contact main spring member 14*a* or O-ring 16. Preferably, wall 12*c* extends a distance from shaft 10*b* at least equal to the distance spring member 14*a* extends from shaft 10*b;* more preferably, wall 12*c* extends a distance from shaft 10*b* at least equal to twice the distance spring member 14*a* extends upwardly from shaft 10*b*.

Stop 12 is preferably connected to shaft 10*b* by gluing or cementing with a glue or cement that will adhere to the material from which shaft 10*b* is constructed. Glue or cement may be applied to bottom surface 12*a* or to shaft 10*b*. Preferably an epoxy type of glue is utilized. If desired, stop 12 can be formed from glue such as an epoxy resin in a mold, then transferred to shaft 10*b* after the glue has hardened or cured, and glued to shaft 10*b*. However, if desired, stop 12 could be made from any rigid materials such as thermosetting or thermoplastic polymeric material, metal such as aluminum or steel, or the like.

Furthermore, if desired, stop 12 can be formed on shaft 10*b* by applying layers of glue to shaft 10*b* until the desired shape is achieved. Excess glue may be filed, scraped, or otherwise removed from shaft 10*b* to form the exact shape desired.

Stop 12 extends partially around the circumference of shaft 10*b* as shown in the drawings, and is oriented on the side of shaft 10*b* away from the bow from which arrow 10 is being shot, or arrow rest connected to the bow, to prevent stop 12 from striking the bow or arrow rest and deflecting arrow 10. The distance stop 12 extends partially around shaft 10*b* can be varied, so long as stop 12 does not strike the bow or arrow rest connected to the bow. Preferably, stop 12 extends angularly around less than one-half the circumference of shaft 10*b*, most preferably about 150° around the 360° circumference of shaft 10*b*.

Figure 5:
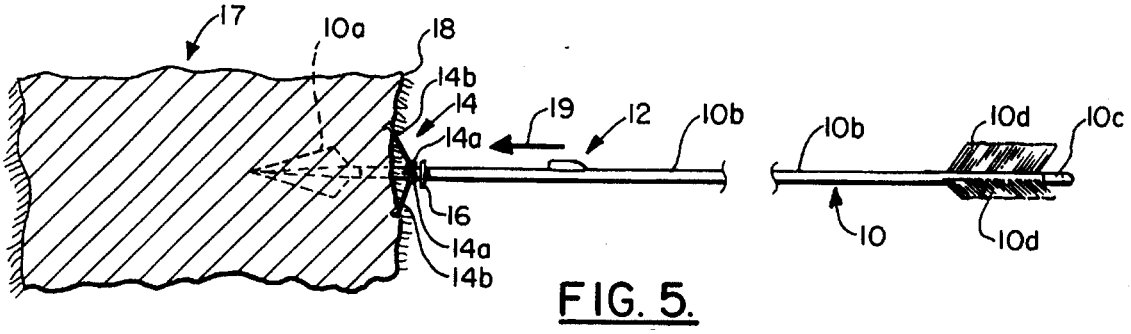
FIG. 5 is a side view, partly cross-sectional, partly cut-away view of an arrow having the stopping assembly of the invention connected thereto as the arrow begins to penetrate an animal.
Figure 6:
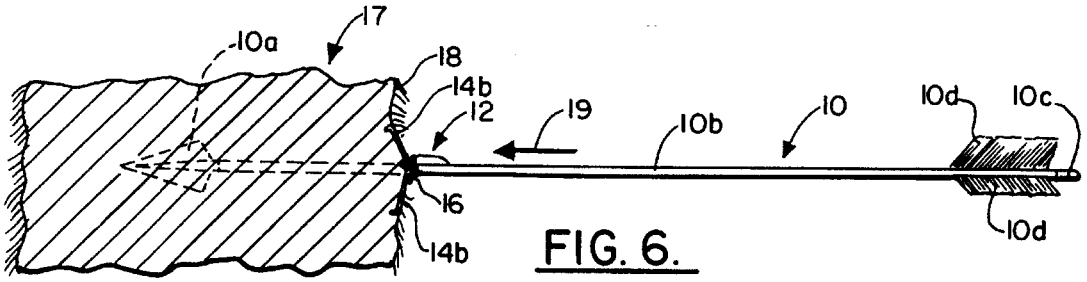
FIG. 6 is a side view, partly cross-sectional, partly cut-away view of an arrow having the stopping assembly of the invention connected thereto as the slidable penetration limiter assembly mounted on the shaft of the arrow strikes the stop to limit the distance the arrow penetrates an animal.
Figure 7:
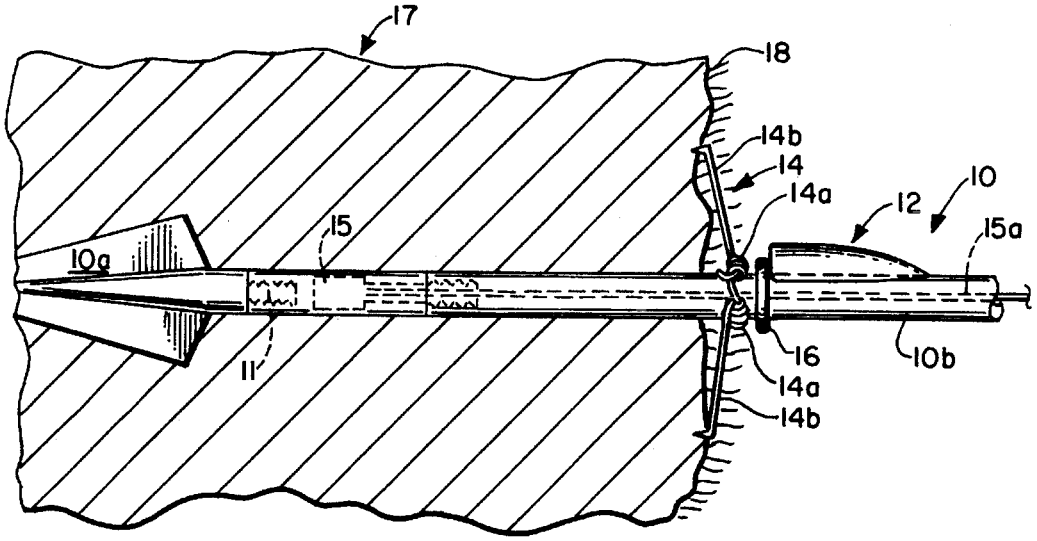
FIG. 7 is a side view, partly cross-sectional, partly cut-away view of an arrow containing a radio transmitter therein and having the stopping assembly of the invention connected thereto as the slidable penetration limiter assembly mounted on the shaft of the arrow strikes the stop to limit the distance the arrow penetrates an animal.
Figure 8:
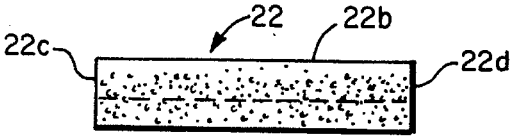
FIG. 8 is a side view of a frangible material utilized in a second embodiment of the invention to reduce the velocity of the arrow prior to the slidable penetration limiter striking the stop.
Figure 9:
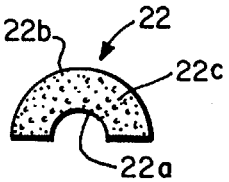
FIG. 9 is a front view of the frangible material shown in FIG. 8.

To utilize the present invention to limit the distance arrow 10 penetrates an animal, stop 12 is connected to shaft 10*b* as explained above. Penetration limiter 14 is then placed adjacent to the front end of arrow 10, and broadhead 10*a* (or any other desired arrow point) is connected to the front end of arrow 10. When broadhead 10 strikes and penetrates the body of an animal generally indicated by the numeral 17, penetration limiter arms 14 will strike the skin 18 of the animal and begin to slide toward stop 12 as indicated in FIG. 5 as the arrow 10 moves in the direction indicated by arrow 19 in FIG. 5. When arrow 10 reaches the position shown in FIG. 6, penetration limiter 14 strikes stop 12 and penetration ceases. Thus, the broadhead 10*a* may be stopped at any desired depth within the animal 17, and radio transmitter 15 remains in the animal.

Stop 12 may be placed at any desired distance from broadhead 10*a* to achieve any desired distance of penetration. If a large animal such as an elk or bear is being hunted, stop 12 is placed so that the broadhead 10*a* will penetrate the desired distance within the animal. If arrow 10 does not have a radio transmitter therein, and if the animal is missed, the penetration limiter 14 may strike bushes or brush near the animal and stop near the location of the animal when the arrow was shot.

The frictional force of penetration limiter 14 sliding along shaft 10*b* prior to penetration limiter 14 striking stop 12 will decelerate arrow 10 and decrease the velocity of arrow 10 prior to penetration limiter 14 striking stop 12. If further deceleration is desired, one or more elastic O-rings 16 may be placed on shaft 10*b* to provide further deceleration of arrow 10.

Referring now to FIGS. 8–11 to describe a second embodiment of the invention, there is shown an arrow generally indicated by the numeral 10 previously described in FIGS. 4–7 having a second embodiment of the arrow stopping assembly of the invention connected thereto. Arrow 10 has a point 10*a* commonly called a broadhead having threads 11 shown in FIG. 7 which are connected to the front end of arrow shaft 10*b*. Nock 10*c* is connected to the rear end of arrow shaft 10*b*, and fletchings 10*d* are connected to shaft 10*b* adjacent to nock 10*c*.

Figure 10:
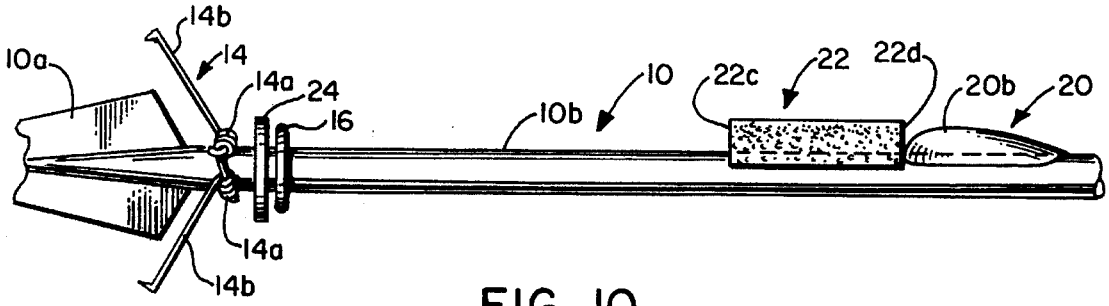
FIG. 10 is a side view, partly cut-away, of the second embodiment of the invention.
Figure 11:
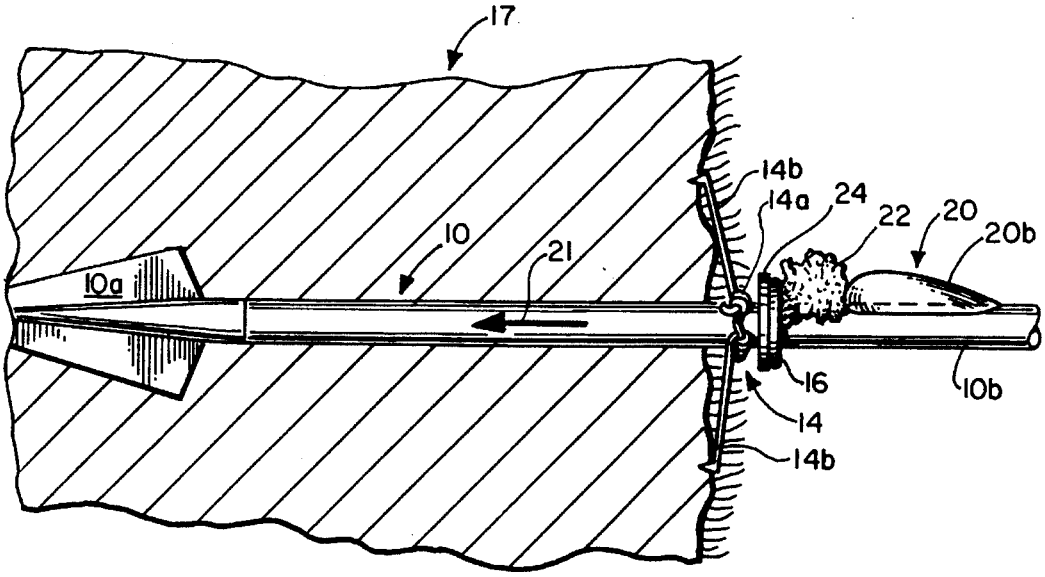
FIG. 11 is a side view, partly cross-sectional, partly cut-away view of an arrow having the stopping assembly of the second embodiment of the invention connected thereto as the slidable penetration limiter assembly mounted on the shaft of the arrow strikes the shock absorber and stop to limit the distance the arrow penetrates an animal.

The arrow stopping assembly includes a stop generally indicated by the numeral 20 shown in FIGS. 10 and 11, a penetration limiter generally indicated by the numeral 14 shown in FIGS. 4–7, 10, and 11, a shock absorber 22 is rigidly connected between stop 20 and penetration limiter 14, and a rigid flat washer 24 shown in FIGS. 10 and 11 is slidably placed between shock absorber 22 and penetration limiter 14. Stop 20 could be identical to stop 12 previously disclosed above in FIGS. 1–7, but stop 20 is preferred for the reasons stated below. Preferably, an O-ring 16 is located between stop 20 and flat washer 24.

Penetration limiter 14 is located on shaft 10*b* adjacent to broadhead 10*a*, and is the same penetration limiter used in the first embodiment of the invention shown in FIGS. 1-7. Penetration limiter 14 is known in the art and is commonly supplied with animal tracking systems such as that shown in U.S. Pat. No. 5,024,447 which was incorporated by reference, having a radio receiver and arrows containing radio transmitters. A radio transmitter in arrow 10 is schematically indicated by phantom lines labeled 15 in FIG. 7 and an antenna connected to radio transmitter 15 is indicated by the numeral 15*a;* however the present invention may be used with conventional arrows that do not have radio transmitters. A penetration limiter of the prior art is disclosed in U.S. Pat. No. 5,022,658 which was incorporated by reference.

Penetration limiter 14 is identical to grabber spring assembly 38 in U.S. Pat. No. 5,022,658, except that penetration limiter 14 is connected directly to shaft 10*b* rather than to a main support bushing as shown in U.S. Pat. No. 5,022,658 and referred to as main support bushing member 36 in U.S. Pat. No. 5,022,658. Thus, penetration limiter 14 includes a plurality, preferably four, cooperating main spring members 14*a* connected together around shaft 10*b* and four arms 14*b* extending outwardly therefrom. Penetration limiter 14 preferably grips shaft 10*b* and is slidable thereon.

Stop 20 is rigidly connected to the shaft 10*b* of arrow 10 as shown in the drawings. Stop 20 is preferably about one inch to about three inches in length. Stop 20 has an arcuate bottom identical to bottom surface 12*a* of the first embodiment of the invention that contacts the surface of shaft 10*b* and mates therewith. The top surface 20*b* of stop 20 extends upward at each end thereof from shaft 10*b* as shown in FIGS. 10 and 11. Stop 20 is preferably connected to shaft 10*b* by gluing or cementing with a glue or cement that will adhere to the material from which shaft 10*b* is constructed. Glue or cement may be applied to the bottom surface of stop 20 or to shaft 10*b*. Preferably an epoxy type of glue is utilized. If desired, stop 20 can be formed from glue such as an epoxy resin in a mold, then transferred to shaft 10*b* after the glue has hardened or cured, and glued to shaft 10*b*. However, if desired, stop 20 could be made from any rigid materials such as thermosetting or thermoplastic polymeric material, metal such as aluminum or steel, or the like.

Furthermore, if desired, stop 20 can be formed on shaft 10*b* by applying layers of glue to shaft 10*b* until the desired shape is achieved. Excess glue may be filed, scraped, or otherwise removed from shaft 10*b* to form the exact shape desired.

Stop 20 extends partially around the circumference of shaft 10*b* as shown in the drawings, and is oriented on the side of shaft 10*b* away from the bow from which arrow 10 is being shot, or arrow rest connected to the bow, to prevent stop 20 from striking the bow or arrow rest and deflecting arrow 10. The distance stop 20 extends partially around shaft 10*b* can be varied, so long as stop 20 does not strike the bow or arrow rest connected to the bow. Preferably, stop 20 extends angularly around less than one-half the circumference of shaft 10*b*, most preferably about 150° around the 360° circumference of shaft 10*b*.

Connected adjacent to stop 20 is shock absorber 22. Shock absorber 22 is preferably constructed from a sponge-like or frangible material which will crush or shear as shown in FIG. 11 when struck by flat washer 24 to decelerate arrow 10 prior to washer 24 striking stop 20. Exemplary of such materials are foamed thermoplastic or thermosetting polymeric materials, polystyrene, synthetic rubber, or the like.

Stop 20 extends above shaft 10*b* a distance sufficient for stop 20 to contact washer 24 or O-ring 16. Preferably, stop 20 extends a distance from shaft 10*b* at least equal to the distance washer 24 extends from shaft 10*b*.

Washer 24 extends above shaft 10*b* a distance at least equal to the distance spring member 14*a* extends from shaft 10*b;* more preferably, washer 24 extends a distance from shaft 10*b* at least equal to twice distance spring member 14*a* extends from shaft 10*b*.

Shock absorber 22 is connected to the shaft 10*b* of arrow 10 as shown in the drawings. Shock absorber 22 has an arcuate bottom surface 22*a* identical to bottom surface 12*a* of the first embodiment of the invention that contacts the surface of shaft 10*b* and mates therewith. The top surface 22*b* of shock absorber 22 is preferably parallel to the shaft 10*b* and has a front edge 22*c* and a rear edge 22*d* which extend vertically upward from shaft 10*b* as shown in FIGS. 10 and 11.

Shock absorber 22 extends partially around the circumference of shaft 10*b* as shown in FIGS. 8–11 and is oriented on the side of shaft 10*b* away from the bow from which arrow 10 is being shot, or arrow rest connected to the bow, to prevent shock absorber 22 from striking the bow or arrow rest and deflecting arrow 10. Shock absorber 22 is aligned with stop 20. The distance shock absorber 22 extends partially around shaft 10*b* can be varied, so long as shock absorber 22 does not strike the bow or arrow rest connected to the bow. Preferably, shock absorber is about one inch to two inches in length. Preferably, shock absorber 22 extends angularly around less than one-half the circumference of shaft 10*b*, most preferably about 150° around the 360° circumference of shaft 10*b*.

Shock absorber 22 is preferably connected to shaft 10*b* by gluing with a glue that will adhere to the material from which shaft 10*b* is constructed. Glue may be applied to the bottom surface of shock absorber 22 or to shaft 10*b*.

If desired, shock absorber 22 may be constructed from a variety of materials having different densities to provide different rates of deceleration over the length of the shock absorber. A shock absorber may then be selected to fit the poundage of the bow and the type of animal being shot with the arrow.

To utilize the second embodiment of present invention to limit the distance arrow 10 penetrates an animal, stop 20, shock absorber 22, and flat washer 24 are connected to shaft 10*b* as explained above. Penetration limiter 14 is then placed adjacent to the front end of arrow 10, and broadhead 10*a* (or any other desired arrow point) is connected to the front end of arrow 10. When broadhead 10 strikes and penetrates the body of an animal generally indicated by the numeral 17, penetration limiter arms 14*b* will strike the skin 18 of the animal and penetration limiter 14 and washer 24 will begin to slide toward shock absorber 22 and stop 20 as indicated in FIG. 11 as the arrow 10 moves in the direction indicated by arrow 21 in FIG. 11. When arrow 10 reaches the position shown in FIG. 11, penetration limiter 14 forces flat washer 24 against shock absorber 22 and crushes and/or shears shock absorber 22 until flat washer 24 strikes stop 20 and penetration ceases. Shock absorber 22 may shear completely away from shaft 10*b* if arrow 10 has sufficient velocity upon impact with an object. Thus, the broadhead 10*a* may be stopped at any desired depth within the animal 17, and radio transmitter 15 remains in the animal.

Stop 20 may be placed at any desired distance from broadhead 10*a* to achieve any desired distance of penetration. If a large animal such as an elk or bear is being hunted, stop 20 is placed so that the broadhead 20*a* will penetrate the desired distance within the animal. If arrow 10 does not have a radio transmitter therein, and if the animal is missed, the penetration limiter 14 may strike bushes or brush near the animal and stop near the location of the animal when the arrow was shot.

The frictional force of penetration limiter 14 sliding along shaft 10*b* will decelerate arrow 10 and decrease the velocity of arrow 10 prior to washer 24 striking shock absorber 22.

Shock absorber 22 then further decelerates arrow 10 as it crushes and/or shears. When flat washer 24 strikes stop 20, penetration of the arrow into the animal usually ceases. However, if a high powered bow with a high poundage draw string is being used by the hunter, such as an 80 pound bow, flat washer 24 may shear some of the sloping edge of stop 20 from shaft 10*b* to further decelerate arrow 10. Stop 20 could be shaped identical to stop 12, but it is preferred that the shape of stop 20 be employed to enable some shearing of stop 20 by washer 24 if the arrow is traveling at very high velocity. If further deceleration is desired prior to washer 24 striking stop 20, one or more elastic O-rings 16 may be placed on shaft 10*b* between flat washer 24 and shock absorber 22 to provide further deceleration of arrow 10.

Figure 12:
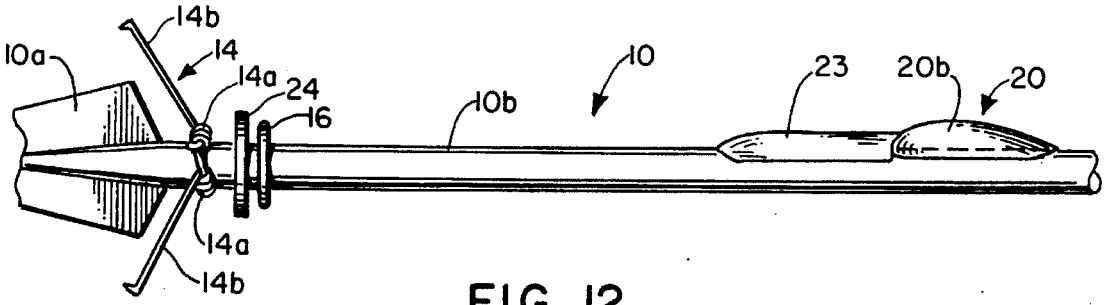
FIG. 12 is a side view, partly cut-away, of the preferred embodiment of the shock absorber of the invention.
Figure 13:
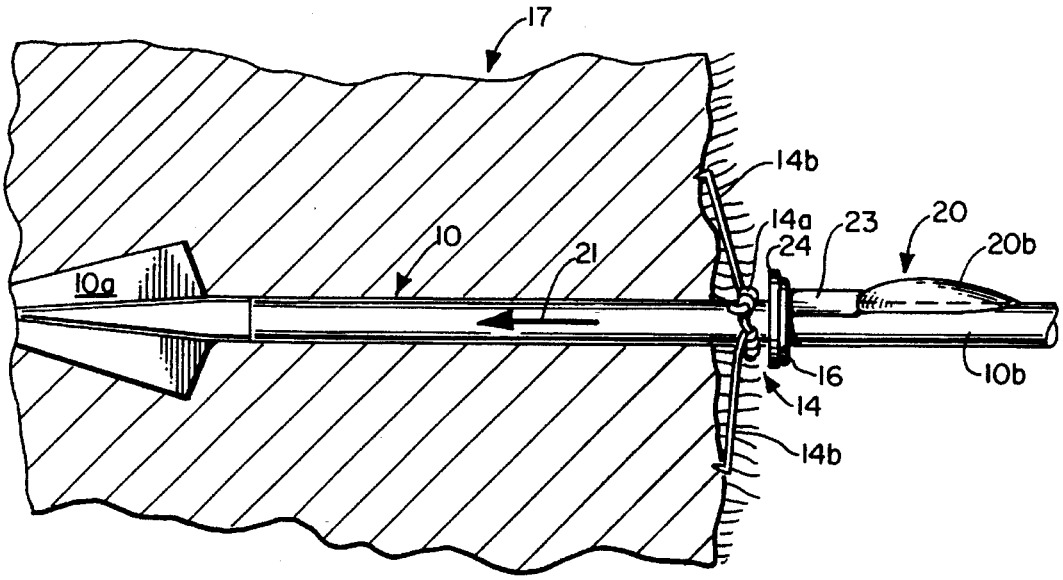
FIG. 13 is a side view, partly cross-sectional, partly cut-away view of an arrow having the stopping assembly of the invention connected thereto as the slidable penetration limiter assembly mounted on the shaft of the arrow strikes the preferred shock absorber and stop to limit the distance the arrow penetrates an animal.

The preferred shock absorber of the invention is indicated by the numeral 23 in FIGS. 12 and 13. Shock absorber 23 preferably is constructed by applying individual layers of a glue that can be sheared off by washer 24 as indicated in FIGS 12 and 13. The resistance of shock absorber 23 to washer 24 can be increased by applying more layers of glue. The thickness and number of layers of glue can be varied as desired to achieve the desired resistance and deceleration of arrow 10. The resistance of shock absorber 23 can be increased by applying a stronger glue to the arrow shaft. Furthermore, two or more different types of glue can be used to vary the rate of deceleration of arrow 10 by shock absorber 23. Shock absorber 23 performs in the same manner as shock absorber 22 as previously explained above.

Although the preferred embodiments of the invention have been described in detail above, it should be understood that the invention is in no sense limited thereby, and its scope is to be determined by that of the following claims:

What is claimed is:

1. In an arrow penetration brake assembly mounted on an arrow to decelerate the arrow shaft of an arrow shot from a bow when said arrow contacts an object, said arrow having a point on one end for penetrating an object, a nock on the other end of said arrow, and fletchings on said arrow adjacent to said nock, said brake assembly having a penetration limiter slidably connected to the arrow shaft adjacent to the point of said arrow, said penetration limiter having a plurality of arms extending therefrom for contacting the object struck with said arrow, the improvement comprising a rigid stop means rigidly connected to said arrow shaft for contacting and stopping said penetration limiter when said penetration limiter slides along said arrow shaft, said stop means extending partially around the circumference of said arrow shaft, shock absorbing means for decelerating said arrow shaft rigidly connected to said arrow shaft between said stop means and said penetration limiter means, and a washer slidably connected to said arrow shaft between said shock absorbing means and said penetration limiter means.

2. The brake assembly of claim 1 wherein said stop means is connected to said arrow shaft between said penetration limiter and said fletchings.

3. The brake assembly of claim 2 wherein said stop means extends partially around less than one-half of the circumference of said arrow shaft.

4. The brake assembly of claim 3 wherein said stop means extends about 150° around the circumference of said arrow shaft.

5. The brake assembly of claim 2 wherein said stop means is connected to the portion of said arrow which does not contact said bow during release of said arrow from said bow.

6. The brake assembly of claim 2 wherein said stop means is oriented on said arrow to prevent contact between said stop and said bow.

7. The brake assembly of claim 2 wherein O-ring means for decelerating said arrow is slidably connected to said arrow adjacent to said penetration limiter between said penetration limiter and said stop means.

8. The brake assembly of claim 1 wherein said stop means is constructed from a rigid material.

9. The brake assembly of claim 1 wherein said stop is glued to said arrow shaft.

10. The brake assembly of claim 1 wherein said stop is constructed from glue.

11. The brake assembly of claim 10 wherein in said glue is an epoxy glue.

12. The brake assembly of claim 1 wherein said shock absorbing means is aligned with said stop means on said shaft of said arrow.

13. The brake assembly of claim 12 wherein said shock absorbing means is frangible.

14. The brake assembly of claim 13 wherein said shock absorbing means is crushable.

15. The brake assembly of claim 14 wherein O-ring means for decelerating said arrow is slidably connected to said arrow adjacent to said penetration limiter between said penetration limiter and said shock absorbing means.

16. In an arrow penetration brake assembly mounted on an arrow to decelerate the arrow shaft of an arrow shot from a bow when said arrow contacts an object, said arrow having a point on one end for penetrating an object, a nock on the other end of said arrow, and fletchings on said arrow adjacent to said nock, said brake assembly having a penetration limiter slidably connected to the arrow shaft adjacent to the point of said arrow, said penetration limiter having a plurality of arms extending therefrom for contacting the object struck with said arrow, the improvement comprising a rigid stop means rigidly connected to said arrow shaft for contacting and stopping said penetration limiter when said penetration limiter slides along said arrow shaft, said stop means extending partially around the circumference of said arrow shaft, said stop means being connected to the portion of said arrow which does not contact said bow during release of said arrow from said bow, said stop means being connected to said arrow shaft between said penetration limiter and said fletchings, shock absorbing means for decelerating said arrow shaft rigidly connected to said arrow shaft between said stop means and said penetration limiter means, and a washer slidably connected to said arrow shaft between said shock absorbing means and said penetration limiter means.

17. The brake assembly of claim 16 wherein said shock absorbing means is frangible.

* * * * *